US005098103A

United States Patent [19]

MacKeil

[11] Patent Number: 5,098,103

[45] Date of Patent: Mar. 24, 1992

[54] FIXED COMPENSATING LOFT GOLF CLUB HEAD

[76] Inventor: Robert F. MacKeil, 19 Mendum St., Melrose, Mass. 02176

[21] Appl. No.: 706,309

[22] Filed: May 28, 1991

[51] Int. Cl.[5] ..... A63B 53/04

[52] U.S. Cl. ..... 273/175; 273/167 J

[58] Field of Search ..... 273/175, 167 J

[56] References Cited

U.S. PATENT DOCUMENTS 1,229,014 4/1919 O'Hara ..... 273/167 J X
1,982,087 11/1934 Wantz ..... 273/167 J X
2,395,837 3/1946 Baymiller et al. ..... 273/175
3,368,812 2/1968 Baldwin ..... 273/175 X
4,884,808 12/1989 Retzer ..... 273/167 J X
4,951,953 8/1990 Kim ..... 273/175 X

*Primary Examiner*—William H. Grieb

[57] ABSTRACT

The striking face of any golf club, except a putter, is to incorporate a face loft angle that is fixed, but varies from the toe to the heel and is more lofted toward the heel than at the toe.

The purpose is to mitigate the error in ball trajectory that is caused when the ball is struck some distance from the center of gravity of the club head face.

15 Claims, 1 Drawing Sheet

FIXED COMPENSATING LOFT GOLF CLUB HEAD

BACKGROUND OF THE INVENTION

1. Field of the Invention

The subject invention relates to the striking face of any golf club head except a putter.

2. Prior Art

When a golf club strikes the ball at any point, some distance from the club face center of gravity, a twisting will occur that causes errors in trajectory, direction and distance.

Past solutions to this problem have focused on rearranging or adding to the weight of the head or the use of stiffer shafts. However, the weight of the head is limited by the golfers' ability to swing it properly and the re-arranging of weight is limited by structural strength considerations. Stiffer shafts help some golfers, but no shaft can prevent twisting when the forces reach the hands of the golfer. Stiff shafts also create a heavy "feel" that does not suit all golfers.

The above solutions to the problem, while imperfect and possessing some disadvantages, are nevertheless useful to some golfers. The subject invention does not preclude the use of these partial solutions but may complement their use or be utilized in their absence.

Club heads that are adjustable or incorporate moving parts do not conform to the rules of the game.

There is no known club head, the face loft angle of which is fixed yet varies along the breadth of the face, as does the subject invention.

SUMMARY OF THE INVENTION

The subject invention is a golf club head, or modification or addendum thereto, the striking face of which incorporates a loft angle that varies, in continuous but not necessarily consistent fashion, from the toe to the heel of the club face, and being more lofted toward the heel and/or less lofted toward the toe, than at the center.

The object is to mitigate the normal tendency of the club face to point downward, or lose loft, when struck toward the heel, and conversely, to point upward and gain loft when struck toward the toe.

DETAILED DESCRIPTION

The face of every golf club, except the putter, is at an angle to the shaft. As measured by standard industry practices, this is called the "loft" angle. This angle determines the trajectory of the ball and thus the distance.

Figure 1:
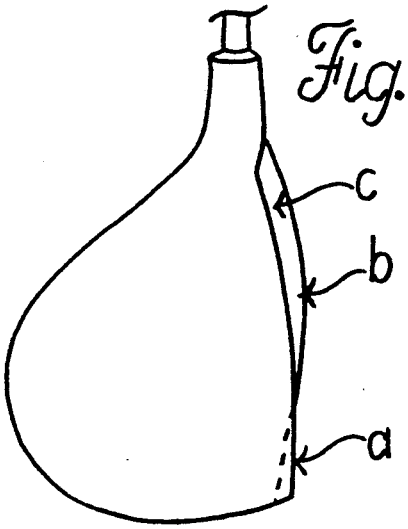
FIG. 1 is a top view of a club head incorporating the subject invention.
Figure 2:
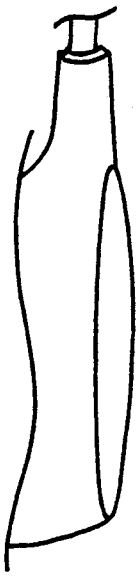
FIG. 2 is a partial top view of a conventional club head.
Figure 4:
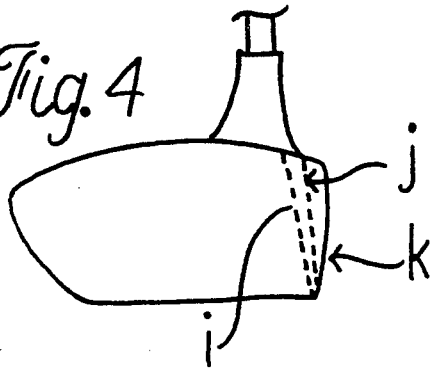
FIG. 4 is a toe end view of a club head incorporating the invention.

The subject invention embodies a striking face, the loft angle of which varies from the toe to the heel of the club head face, and being of lesser loft toward the toe, as in FIG. 1,*a*, and/or greater loft toward the heel, as in FIG. 1,*c*, than at the center, as in FIG. 1,*b*. FIG. 4, *i,j,k*, represents the loft angle at the heel, center, and toe respectively. FIG. 2, a partial top view of a conventional club head, shows the constant loft of a conventional club head. This constant loft is characteristic of conventional irons as well as woods.

Figure 3:
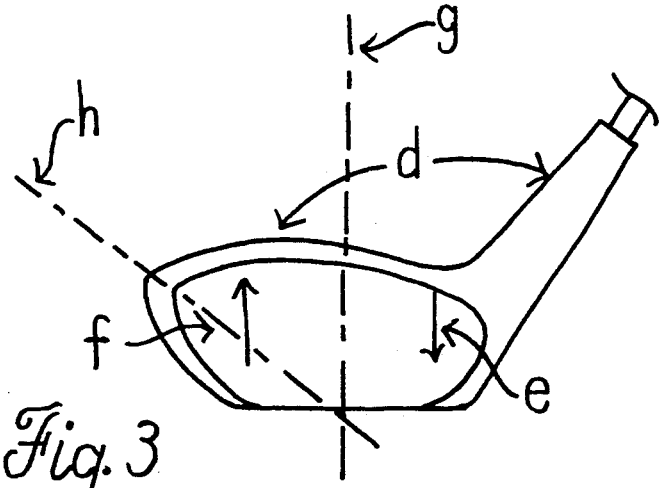
FIG. 3 is a face view of a club head that may or may not incorporate the invention.

The shaft of any golf club, being attached at an oblique angle at the heel, as in FIG. 3,*d*, creates a hinge action that causes the face to point more nearly downward and lose loft when struck away from the club face center of gravity and toward the heel. See FIG. 3,*e*. Conversely, when struck toward the toe the club face will point more upward and gain loft. See FIG. 3,*f*.

The subject invention mitigates this effect by incorporating a continuously compensating loft across the breadth of the club head face, resulting in a more nearly constant loft angle when the golf ball is struck toward the heel or toe of the club face. In addition to improving trajectory, the increased contact pressure caused by the blunter angle, occurring on toe hits, aids in imparting the desired spin on the ball, thus improving direction. See FIG. 4,*k*.

The invention can be applied to some existing golf club heads by the addition or removal of material therefrom.

As applied to club heads that normally have a curved face, commonly known as "woods" or "metalwoods":

As measured on a horizontal plane, these club head faces have a convex "bulge" curve, the purpose of which is to compensate for clockwise or counter-clockwise spin caused when the club face meets the ball to the left or right of its center of gravity. Disregarding vertical plane curvature, known as "roll", the face of a conventional club head, for drafting purposes, may be said to be generated by the surface of a cylinder, or similar solid, the axis of which is at an angle to the shaft equal to the designated loft angle when viewed from the toe end, and perpendicular to the ground when viewed from the face, as in FIG. 3,*g*. This may vary somewhat, as some clubs have a face angle that is open or closed which will cause the axis to appear tilted when viewed from the front.

The subject invention requires that the face surface be generated, for drafting purposes, by a solid of curved surface, the axis of which is distinctly not perpendicular to the ground when viewed from the face, but is leaning away from the shaft as in FIG. 3,*h*, so the axis will be diagonal to the face. The axis may or may not intersect the face.

The shape of the generating solid need not be cylindrical but may vary in cross section and longitudinally to adjust the rate or amount of compensation desired. For instance, more compensation might be desired toward the toe than toward the heel. Factors that bear on the proper shape and location of the generating solid include location of center of gravity, total weight, shaft stiffness and lie angle of the particular club.

The invention as applied to clubs that are normally flat on the striking face:

At present the "Rules of Golf", as promulgated by the U.S.G.A. require that the striking face not be concave. In order to meet this requirement it will be necessary to incorporate sufficient "bulge" or "roll" into the face to overcome the inherent concavity created by forming a face that imbodies this invention. Otherwise, the application of the invention is similar to the above description of normally curved club face heads.

The best application of the invention is relative to the less lofted clubs because their lesser head weight and less upright shaft attachment contribute to instability on miss-hits.

Manufacture of club heads that embody this invention would be by similar means as is presently utilized in the absence of this improvement.

The "loft angle" referred to throughout is taken to mean degrees from perpendicular of the face when the shaft is in the playing position and perpendicular to the ground when viewed from the toe. See FIG. 4,*i,j,k*.

To have a substantial effect, the amount of variation in loft, from the toe to heel, should equal or exceed 5°, or a minimum of 3° variation from the face center of gravity to the toe or heel. The optimum variation from toe to heel depends on the inherent instability of the club head, with 8° to 14° of variation being suitable for a driver. In the case of a highly unstable head, such as a wooden headed driver with a low center of gravity mounted on a light shaft, the best loft angle might be negative at the toe end of the face.

I claim:

1. An improved golf club head, wherein the improvement comprises a striking face, the loft angle of which varies from the toe to the heel of the club face, and being significantly less lofted at the toe than at the heel, the purpose being to maintain a more nearly constant loft angle when the golf ball is struck toward the heel or toe of the club face.

2. A golf club head as defined in claim 1, wherein the improvement is incorporated into a club head normally described as a "wood" or "metalwood", and the loft angle of which varies a minimum of approximately 5° from the tow to the heel, but may vary more, and being less lofted at the toe than at the heel.

3. A golf club head as defined in claim 1, wherein the improvement is incorporated into a club head normally described as a "wood" or "metalwood", and the loft angle of which varies a minimum of approximately 3° from the toe to the center of the face, but may vary more, and being less lofted at the toe than at the center.

4. A golf club head as defined in claim 1, wherein the improvement is incorporated into a club head normally described as a "wood" or "metalwood", and the loft angle of which varies a minimum of approximately 3+ from the heel to the center of the club face, but may vary more, and being more lofted at the heel than at the center.

5. A golf club head as described in claim 1, wherein the improvement is incorporated into a club head normally described as an "iron", and the loft angle of which varies a minimum of approximately 3+ from the toe to the heel of the club face, but may vary more, and being less lofted at the toe than at the heel.

6. An addendum to a golf club head comprising:

a face plate attachable to the striking face, said face plate having a loft angle which varies from the toe to the heel of the club face, and being significantly less lofted at the toe than at the heel, the purpose being to maintain a more constant loft angle when the golf ball is struck toward the heel or toe of the club face.

7. An addendum to a golf club head as defined in claim 6, wherein the club head is one normally described as a "wood" or "metalwood", and the loft angle of said addendum face plate varies a minimum of approximately 5° from the toe to the heel, but may vary more, and being less lofted at the toe than at the heel.

8. An addendum to a golf club head as defined in claim 6, wherein the golf club head is one normally described as a "wood" or "metalwood", and the loft angle of said addendum face plate varies a minimum of approximately 3° from the toe to the center of the face, but may vary more, and being less lofted at the toe than at the center.

9. An addendum to a golf club head as defined in claim 6, wherein the golf club is one normally described as a "wood" or "metalwood", and the loft angle of said addendum face plate varies a minimum of approximately 3° from the heel to the center of the club face, but may vary more, and being more lofted at the heel than at the center.

10. An addendum to a golf club head as defined in claim 6, wherein the golf club is one normally described as an "iron", and the loft angle of said addendum face plate varies a minimum of approximately 3° from the toe to the heel of the club face, but may vary more, and being less lofted at the toe than at the heel.

11. A method of modifying the striking face of a golf club head, comprising;

shaping the striking face so that the loft angle varies from the toe to the heel of the club face, and being significantly less lofted at the toe than at the heel, the purpose being to maintain a more nearly constant loft angle when the golf ball is struck toward the heel or toe of the club face.

12. The method of claim 11, wherein the club head is one that is normally described as a "wood" or "metalwood", and the loft angle of said striking face is varies a minimum of approximately 5° from the toe to the heel, but may vary more, and being less lofted at the toe than at the heel.

13. The method of claim 11, wherein the club head is one that is normally described as a "wood" or "metalwood", and the loft angle of said striking face is varied a minimum of approximately 3+ from the toe to the center of the face, but may vary more, and being less lofted at the toe than at the center.

14. The method of claim 11, wherein the club head is one that is normally described as a "wood" or "metalwood", and the loft angle of said striking face is varied a minimum of approximately 3° from the heel to the center of club face, but may vary more, and being more lofted at the heel than at the center.

15. The method of claim 11, wherein the club head is one that is normally described as an "iron", and the striking face is varied a minimum of approximately 3° from the toe to the heel of the club face, but may vary more, and being less lofted at the toe than at the heel.

* * * * *